US007862202B2

(12) United States Patent
Laso et al.

(10) Patent No.: US 7,862,202 B2
(45) Date of Patent: Jan. 4, 2011

(54) METHOD AND APPARATUS FOR INSTALLING A MOTION SENSOR IN A LUMINAIRE

(75) Inventors: Jose Antonio Laso, Newnan, GA (US); Jamey Vaughan, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 317 days.

(21) Appl. No.: 12/060,123

(22) Filed: Mar. 31, 2008

(65) Prior Publication Data

US 2008/0302929 A1 Dec. 11, 2008

Related U.S. Application Data

(60) Provisional application No. 60/909,231, filed on Mar. 30, 2007, provisional application No. 60/909,279, filed on Mar. 30, 2007.

(51) Int. Cl.
*F21V 17/00* (2006.01)
*F21V 19/00* (2006.01)

(52) U.S. Cl. ..... 362/217.16; 362/217.01; 362/219; 362/225; 362/217.12; 362/217.17

(58) Field of Classification Search ..... 362/217.01, 362/217.12, 217.14, 217.16, 217.17, 404, 362/406, 432, 220, 219, 225; 248/200–316.8
See application file for complete search history.

(56) References Cited

U.S. PATENT DOCUMENTS

| | | | | | |
|---|---|---|---|---|---|
| 3,011,047 | A * | 11/1961 | Spaulding | 362/219 |
| 3,349,237 | A * | 10/1967 | Jackson | 362/219 |
| 3,673,402 | A * | 6/1972 | Weiss | 362/220 |
| 4,208,702 | A * | 6/1980 | Wotowiec | 362/217.08 |
| 5,658,099 | A * | 8/1997 | Pienaar et al. | 405/288 |
| 5,848,833 | A * | 12/1998 | Margulies et al. | 362/147 |
| 6,091,200 | A * | 7/2000 | Lenz | 315/159 |
| 6,447,141 | B1 * | 9/2002 | Waldmann | 362/147 |
| 6,530,674 | B2 * | 3/2003 | Grierson et al. | 362/219 |
| 2006/0028821 | A1 * | 2/2006 | Eaton | 362/276 |

* cited by examiner

*Primary Examiner*—Sandra L O Shea
*Assistant Examiner*—Danielle Allen
(74) *Attorney, Agent, or Firm*—King & Spalding LLP

(57) ABSTRACT

A method and apparatus for motion sensor installation includes an apparatus for installing a lighting accessory to a first luminaire having a luminaire housing. The bracket includes a coupling member operative to couple the bracket to one of the luminaire housings. A support member extends from the coupling member, and is operative to support the lighting accessory a first distance from the luminaire housing. An attachment member that is operative to attach the lighting accessory to the lighting accessory extends from the support member. The bracket couples the lighting accessory to the luminaire housing without extending the length of the luminaire or creating a substantial gap between two luminaires in a linear configuration. In one aspect, the lighting accessory can be a motion sensor that is operative to control the power to one or more of the luminaires.

21 Claims, 10 Drawing Sheets

METHOD AND APPARATUS FOR INSTALLING A MOTION SENSOR IN A LUMINAIRE

RELATED APPLICATIONS

This patent application claims priority under 35 U.S.C. §119 to U.S. Provisional Patent Application No. 60/909,231, entitled "Luminaire with Optics and Method of Mounting Thereof," filed Mar. 30, 2007, and Unites States Provisional Patent Application No. 60/909,279, entitled "Luminaire with Optics and Method of Mounting Thereof," filed Mar. 30, 2007. The complete disclosure of the above-identified priority application is hereby fully incorporated herein by reference.

TECHNICAL FIELD

The present invention relates generally to light fixtures, and more specifically to a method and apparatus for installing a motion sensor or other lighting accessory on a luminaire.

BACKGROUND OF THE INVENTION

The use of fluorescent lamps to illuminate a room or other area is well known in the lighting field. Many conventional luminaires for fluorescent lamps are designed to hold one or more standard-sized tubular fluorescent lamps. For example, some conventional luminaires are designed to hold one or more "T8" fluorescent lamps, wherein the T8 designation indicates that the lamp is tubular and has a diameter of one inch. While the tubular lamps are produced in a wide variety of lengths, a typical conventional luminaire design will only support lamps of a single predetermined length.

In some applications, conventional luminaires for fluorescent lamps are attached in an end-to-end fashion. Attaching luminaires in this manner effectively creates a single luminaire that is made up of several smaller lamps. This is advantageous over a single very long lamp in that shorter tubular lamps are generally less expensive and easier to store than longer lamps. Moreover, in some cases, the total length of attached luminaires can be as long as two hundred feet. When luminaires approach this length, connecting multiple smaller luminaires is the only reasonable solution.

Recently, various users of lighting have become more conscious of their energy use—either as a result of environmental concerns, budgetary concerns, or government regulation—and have sought out methods of reducing their energy use while still providing sufficient lighting to meet their needs. A conventional solution to this problem is the use of motion sensors to control luminaires. Conventional motion sensors are configured to turn the luminaires they control off when the motion sensor has not detected any motion for a predetermined period of time, and to turn the luminaires on when the motion sensor detects motion.

However, the installation of motion sensors can be a costly and cumbersome task. Conventional motion sensors are typically installed either in the ceiling, or on the luminaire itself. Installing a motion sensor in the ceiling requires additional wiring that may not be present in older buildings, and also may result in inefficient placement of motion sensors.

Installing a motion sensor directly on a luminaire can alleviate the need to provide additional wiring, as the motion sensor can control at least the luminaire on which it is installed. Installing a motion sensor directly on a luminaire, however, results in additional problems. First, conventional motion sensors tend to be large—often at least four inches in diameter. A location for the installation of the motion sensor on the luminaire must be provided, which generally results in increasing the length of the luminaire to accommodate the motion sensor. Accordingly, a purchase of new luminaires may be required to retrofit existing facilities with motion sensors.

Second, because an installed motion sensor adds length to a conventional luminaire, the advantageous feature of installing luminaires in series, as described above, becomes less attractive, as the additional length needed to accommodate a motion sensor is multiplied over a long run, adding, for example, four inches for every eight feet of lamps. For example, in very large facilities, such as large warehouses and factories, luminaires may need to be upward of two hundred feet long. Adding four inches for every eight feet of lamps adds over eight feet (or nearly five percent) to the length of the luminaire solely to accommodate the motion sensors. Not only does this additional length result in an undesirable use of space, the additional length makes the alignment of the luminaire with other luminaires that may or may not have motion sensors installed difficult, if not impossible. Furthermore, the additional length added by the motion sensor results in a portion of the luminaire that does not include a lamp, and therefore is not providing light to the surface below. This may result in reduced light levels in certain areas that may not be safe, and may not comply with local building codes or other regulations. Moreover, in facilities having fixed supports for mounting conventional luminaires in the ceiling, the additional length can make the installation of luminaires having motion sensors infeasible because of the cost of adjusting the ceiling supports.

Accordingly, a need exists in the art for a motion sensor that can be installed in a luminaire designed to accommodate tubular fluorescent lamps such that the motion sensor can be installed without adding additional length to the luminaire. A need also exists in the art for a system of adding multiple motion sensors to long rows of fixtures that does not result in the misalignment of fixtures across different rows.

SUMMARY OF THE INVENTION

The present invention can satisfy the above-described needs by providing a method and apparatus for installing a lighting accessory, such as a motion sensor, in a luminaire. In one aspect, the invention can provide a bracket that can be used for installing the lighting accessory in the luminaire such that the bracket can couple the lighting accessory to the luminaire without increasing the length of the luminaire. The bracket can include a coupling member that can couple the bracket to the luminaire. The bracket can also include a support member that can extend from the coupling member and can support the lighting accessory at a distance from the luminaire. The bracket can also include an attachment member that can extend from the support member and can attach the lighting accessory to the bracket.

In some aspects of the invention, the lighting accessory can be a motion sensor that can control the flow of power to the luminaire. In other aspects of the invention, a second luminaire can be coupled to the luminaire in such a way that the bracket can be disposed between the luminaires, yet the bracket may not increase the combined length of the luminaires. In yet another aspect of the invention, the bracket can include a centering member between the support member and the attachment member that can laterally displace the attachment member with respect to the support member such that the lighting accessory can be substantially centered over the luminaire.

In some aspects of the invention, the bracket can be formed from a single sheet of metal that is plastically deformed to form the coupling member, the support member, and the attachment member. In other aspects of the invention, the bracket can support the lighting accessory such that the bracket and the lighting accessory can be disposed in a spaced apart orientation from a lamp installed in the luminaire.

Additional aspects, objects, features, and advantages of the invention will become apparent to those having ordinary skill in the art upon consideration of the following detailed description of illustrated embodiments. For a more complete understanding of the exemplary embodiments of the present invention and the advantages thereof, reference is now made to the following description in conjunction with the accompanying drawings described below.

DETAILED DESCRIPTION OF THE EXEMPLARY EMBODIMENTS

The present invention provides a motion sensor installation bracket capable of installing a motion sensor on a luminaire without extending the length of the luminaire. While the specification describes the exemplary embodiment of a bracket for installing a motion sensor on a luminaire, the bracket is also capable of installing other lighting accessories on a luminaire without extending the length of the luminaire. Other lighting accessories that could utilize the bracket of the present invention include, but are not limited to, photocells, smoke and heat detectors, speakers, security cameras, spotlights, or any other device that is typically mounted in the ceiling or in conjunction with the lighting for a facility.

The term "luminaire" refers generally to an apparatus for providing light. The term "luminaire housing" refers to a portion of a luminaire that is configured to support the various components of a lighting device, which may include, but are not limited to, sockets, switches, reflectors, lamps, power supplies, and any other components of a lighting device. Any spatial references herein such as, for example, "upper," "lower," "above," "below," "rear," "between," "vertical," "angular," "beneath," etc., are for the purpose of illustration only and do not limit the specific orientation or location of the described structure.

Figure 1:
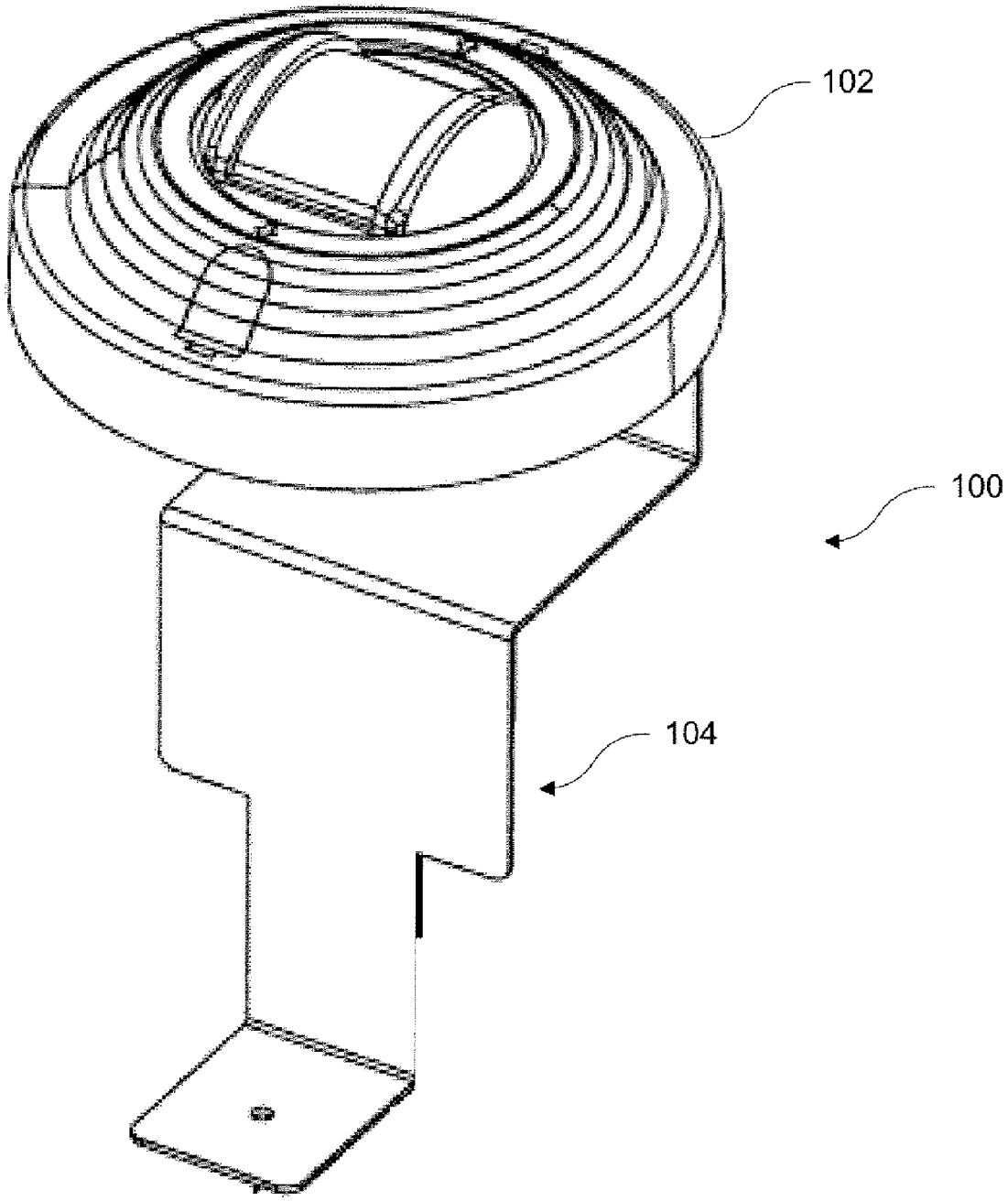
FIG. 1 is a perspective view of a motion sensor apparatus according to certain exemplary embodiments of the present invention.

Referring now to the figures, in which like numerals represent like elements throughout the figures, exemplary embodiments of the present invention will be described. FIG. 1 is a perspective view of a motion sensor apparatus 100 according to certain exemplary embodiments of the present invention. As illustrated by FIG. 1, the motion sensor apparatus 100 includes a motion sensor 102 and motion sensor installation bracket 104.

Figure 2A:
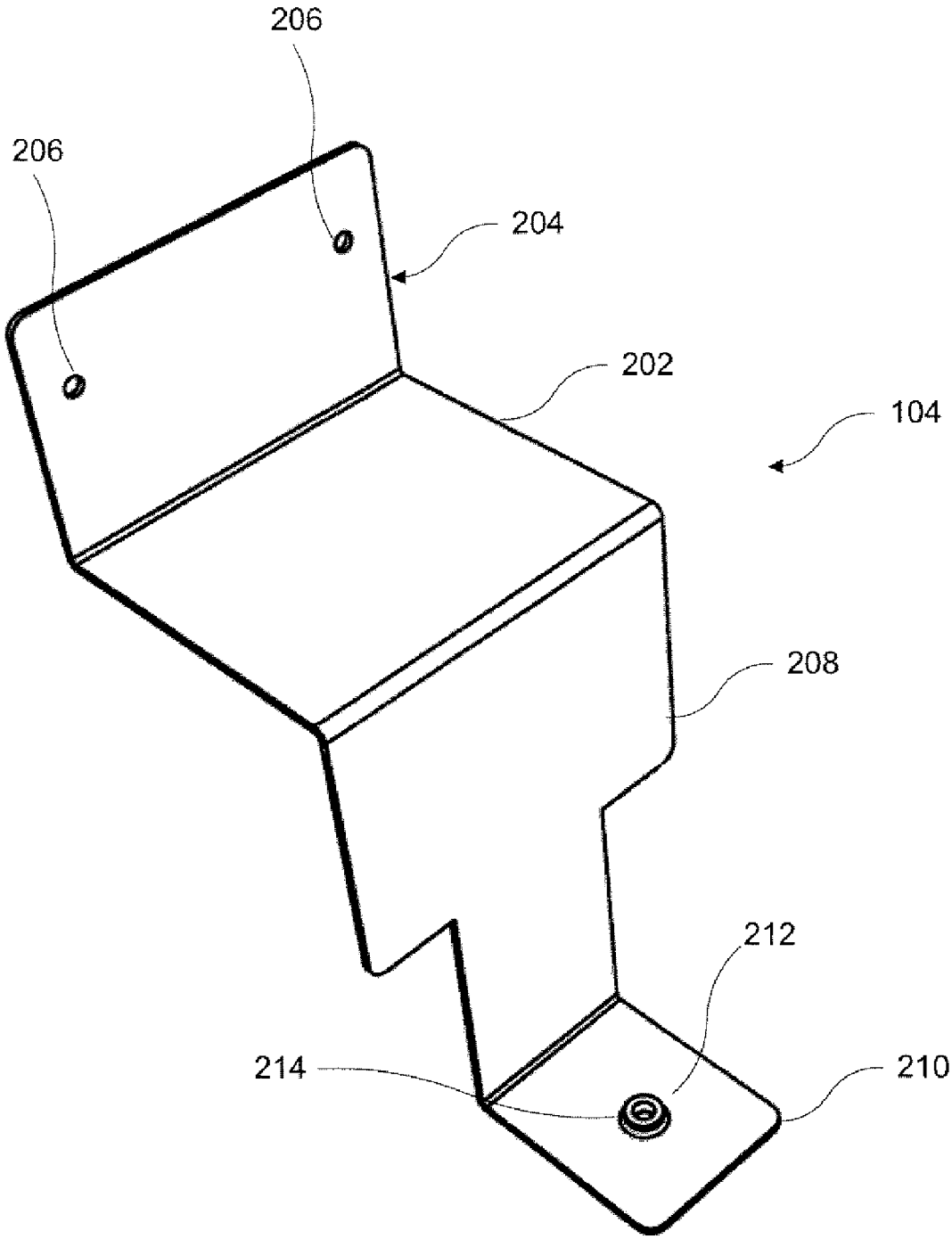
FIG. 2*a* is a perspective view of the motion sensor installation bracket of FIG. 1 according to certain exemplary embodiments of the present invention.

FIG. 2*a* is a perspective view of the motion sensor installation bracket of FIG. 1 according to certain exemplary embodiments of the present invention. Referring now to FIGS. 1 and 2*a*, the bracket 104 includes a number of members that facilitate an appropriate coupling between the motion sensor 102 and the luminaire (not shown). In one exemplary embodiment, the bracket 104 and the corresponding members are formed from a single piece of material that has been plastically deformed, stamped, or molded to form the members. In an alternative embodiment, the members of the bracket 104 are formed individually and bonded or coupled together using adhesives, welding, fasteners, or any other appropriate bonding means. In one exemplary embodiment, the material forming the bracket 104 is a high strength sheet metal such as steel or aluminum. Alternatively, the bracket 104 may be formed from other appropriate materials, such as plastic or composite materials.

The bracket 104 includes an attachment member 204 that is configured to be attached to a motion sensor 102. In one exemplary embodiment, the attachment member 204 includes two fastener holes 206 that accommodate fasteners (not shown) for fastening the motion sensor 102 to the bracket 104; however, fewer or additional fastener holes 206 may be provided on the attachment member 204. In an exemplary embodiment, the fasteners are screws or bolts. In alternative exemplary embodiments, the motion sensor 102 may be attached to the attachment member 204 using any number of conventional means, such as with glue, welding, or a hinge. In an additional alternative embodiment, the bracket 104 and motion sensor 102 may be manufactured as a single assembly, thus alleviating the need to fasten the bracket 104 to the motion sensor 102.

The bracket 104 also includes a centering member 202. In one exemplary embodiment, the centering member 202 couples the attachment member 204 to the support member 208, and displaces the attachment member 204 laterally with respect to the support member 208 such that the attachment member 204 can be coupled to a side of the motion sensor 102. By displacing the attachment member 204 laterally, the motion sensor 102 can be coupled to the bracket 104 while still remaining substantially centered under the junction point of two luminaires. In one exemplary embodiment having eight-foot T8 fluorescent fixtures, centering the motion sensor along the junction of two fixture ends provides a minimal amount of light disruption, thereby increasing the efficiency of the light output of the luminaire. In alternative exemplary embodiments, the centering member 202 may be smaller or absent as appropriate depending on the dimensions of the motion sensor 102 and the various accommodations for a bracket 104 that may be provided on a given motion sensor 102.

The bracket 104 also includes a support member 208. The support member 208 is coupled to the centering member 202 and supports the motion sensor 102 at a distance from the luminaire housing. In one exemplary embodiment, the distance is greater than or equal to the diameter of the lamp being used in the luminaire. The support member 208 is also configured such that it can support the motion sensor 102 at a distance from the luminaire housing without adding length to the luminaire. In one exemplary embodiment, the support member 208 extends vertically or substantially in a vertical direction downward from the luminaire housing.

The bracket 104 also includes a coupling member 210 coupled to the support member 208. The coupling member 210 is configured to couple the bracket 104 to the luminaire housing (not shown). The coupling member 210 includes one or more fastener holes 212. In one exemplary embodiment, the fastener hole 212 includes a raised edge 214 to provide support for a fastener (not shown) engaged with the fastener hole 212. In one exemplary embodiment, the fastener hole 212 can be configured to receive a fastener from the side opposite the raised edge 214 for coupling the bracket 104 to the luminaire housing. In one exemplary embodiment, the fastener hole 212 and raised edge 214 are threaded to receive a correspondingly threaded screw or nut. In an alternative embodiment, the fastener hole 212 may not be threaded, and may be coupled to the luminaire housing other conventional means, such as a bolt and correspondingly threaded nut disposed on opposite sides of the coupling member 210, such that the bolt is passed through the fastener hole 212 and the luminaire housing to join with the nut on the opposing side.

While each individual member of the bracket 104 has been described above as a single piece, one of ordinary skill in the art will recognize that each member may be made up of two or more individual pieces of metal or other material.

Figure 2B:
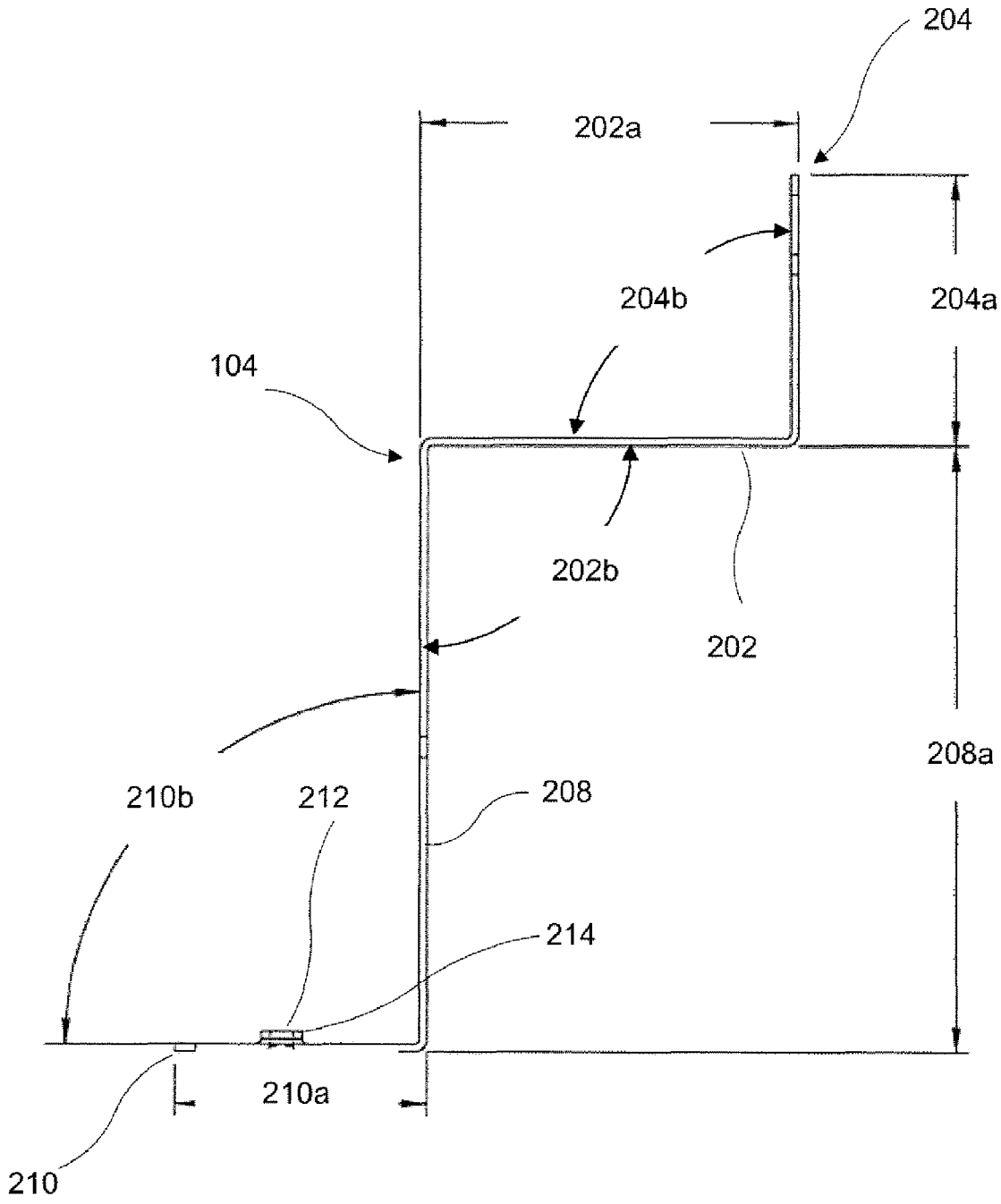
FIG. 2*b* is a side view of the motion sensor installation bracket of FIG. 1 according to certain exemplary embodiments of the present invention.
Figure 2C:
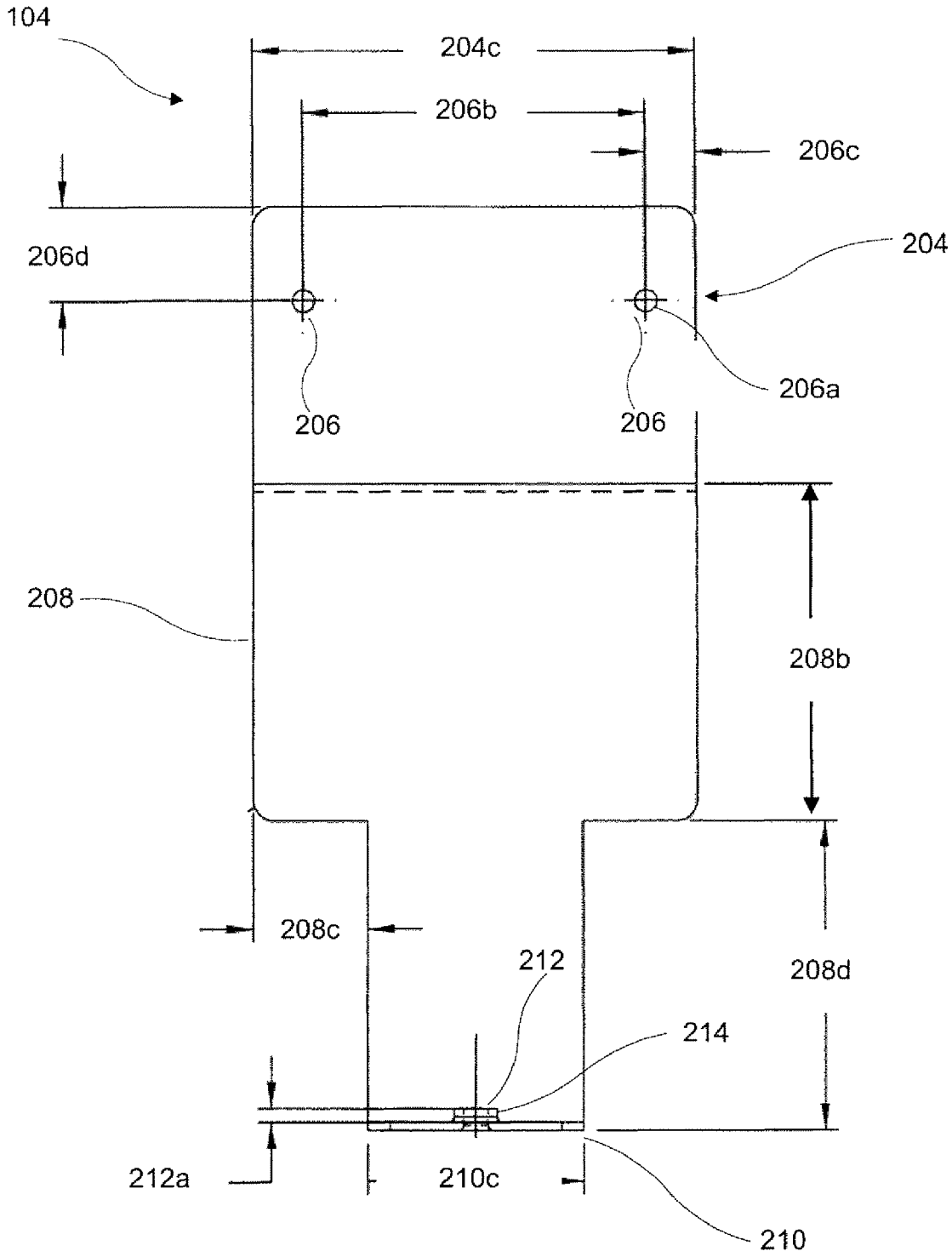
FIG. 2*c* is a front elevation view of the motion sensor installation bracket of FIG. 1 according to certain exemplary embodiments of the present invention.
Figure 2D:
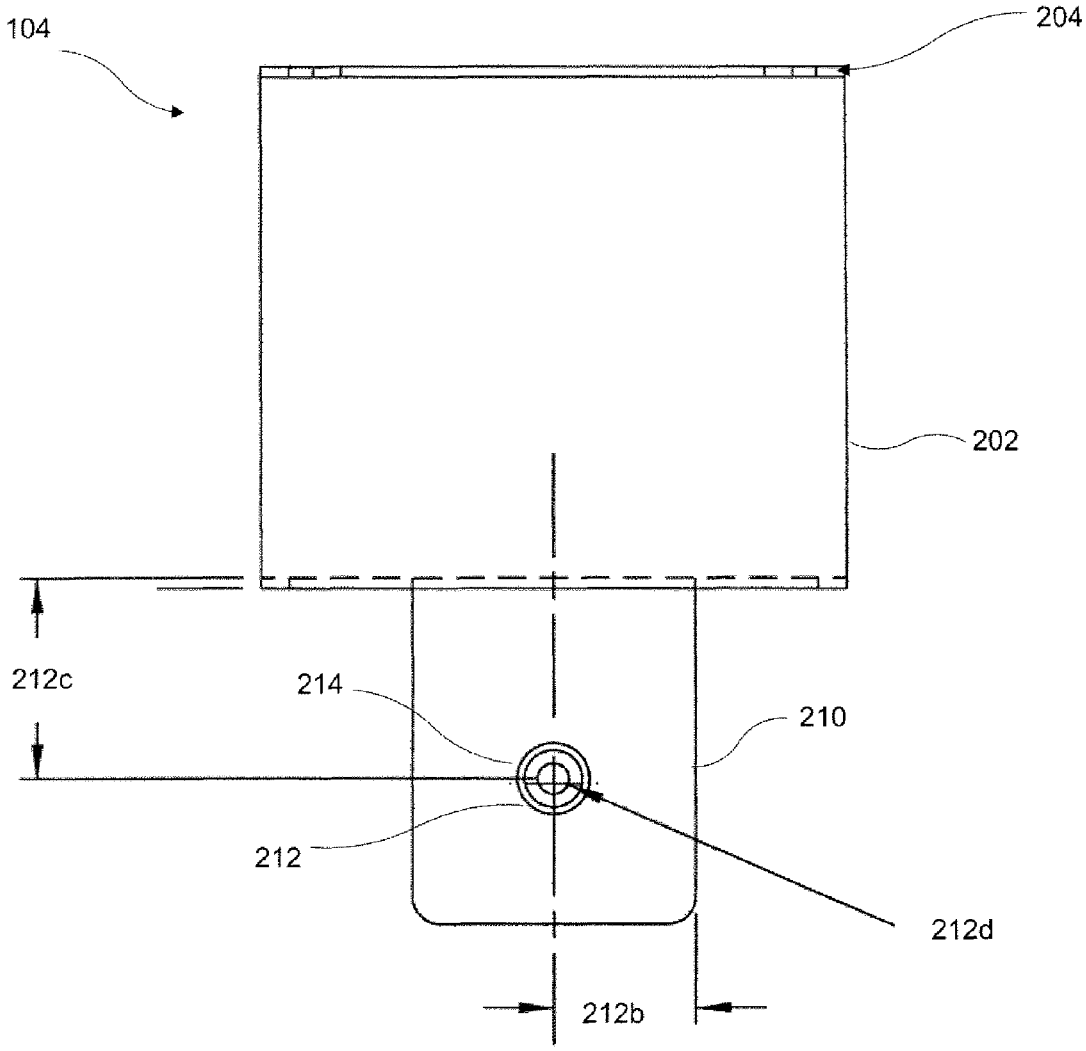
FIG. 2*d* is a top view of the motion sensor installation bracket of FIG. 1 according to certain exemplary embodiments of the present invention.

FIGS. 2*b*, 2*c*, and 2*d* provide additional views of the exemplary bracket 104 of FIG. 1, and illustrate exemplary dimensions of the bracket 104. While the dimensions are directed to an embodiment of the bracket 104 configured for installing a motion sensor 102 to certain luminaire housings, one of ordinary skill in the art will recognize that the dimensions provided herein are merely exemplary, and changes to the dimensions to modify the bracket 104 for various luminaire housings, motion sensors 102, or other lighting accessories are within the scope of the present invention.

FIG. 2*b* is a side view of the motion sensor installation bracket 104 of FIG. 1 according to certain exemplary embodiments of the present invention. As FIG. 2*b* illustrates, the attachment member 204 has a length 204*a* and meets the centering member 202, forming an angle 204*b*. In one exemplary embodiment, the length 204*a* can be 1.680 inches, and the angle 204*b* can be 90 degrees, or can be any suitable angle between 0 and 180 degrees. The centering member 202 has a length 202*a* and meets the support member 208, forming an angle 202*b*. In one exemplary embodiment, the length 202*a* can be 2.332 inches and the angle 202*b* can be ninety degrees, or can be any suitable angle between 0 and 180 degrees. The support member 208 has a length 208*a*. In one exemplary embodiment, the length 208*a* can be 3.75 inches. The support member 208 meets the coupling member 210, which has a length 210*a*, forming an angle 210*b* at the junction with the support member 208. In one exemplary embodiment, the length 210*a* can be 1.547 inches and the angle 210*b* can be ninety degrees, or can be any suitable angle between 0 and 180 degrees.

FIG. 2*c* is a front elevation view of the motion sensor installation bracket 104 of FIG. 1 according to certain exemplary embodiments of the present invention. As FIG. 2*c* illustrates, the attachment member 204 has a width 204*c*, which, in one exemplary embodiment can be 2.588 inches. The fastener holes 206 disposed in the attachment member 204 have a diameter 206*a*, are spaced a distance 206*b* apart, are oriented a distance 206*c* from the respective sides of the attachment member 204 and are a distance 206*d* from the top of the attachment member 204. In one exemplary embodiment, the diameter 206*a* can be 0.125 inches, and the distances 206*b*, 206*c*, and 206*d* can be 2.0, 0.292, and 0.554 inches respectively.

In one exemplary embodiment, where the support member 208 meets the centering member 202, the support member 208 is the same width 204*c* as the attachment member 204. In this exemplary embodiment, after a distance 208*b*, the support member 208 narrows a distance 208*c* to substantially equal the width 210*c* of the coupling member 210. The narrow portion of the support member 208 has a length 208*d*. In one exemplary embodiment, the distances 208*b*, 208*c*, and 208*d* are 1.928, 0.669, and 1.822 inches respectively. In this exemplary embodiment, the width 210*c* of the coupling member 210 can be 1.25 inches. The view of FIG. 2*c* also demonstrates the raised edge of the fastener hole, which is raised a distance 212*a*. In one exemplary embodiment, the distance 212*a* can be 0.080 inches.

FIG. 2*d* is a top view of the motion sensor installation bracket 104 of FIG. 1 according to certain exemplary embodiments of the present invention. As illustrated by FIG. 2*d*, the fastener hole 212 is centered horizontally on the coupling member 210, and therefore the center of the fastener hole 212 is disposed a distance 212*b* from each side of the coupling member 210. The center of the fastener hole 212 is disposed a distance 212*c* from the support member 208. In addition, the fastener hole has a diameter 212*d*. In one exemplary embodiment, the diameter 212*d* can be 0.14 inches, and the distances 212*b* and 212*c* can be 0.625 and 0.895 inches, respectively.

Figure 3A:
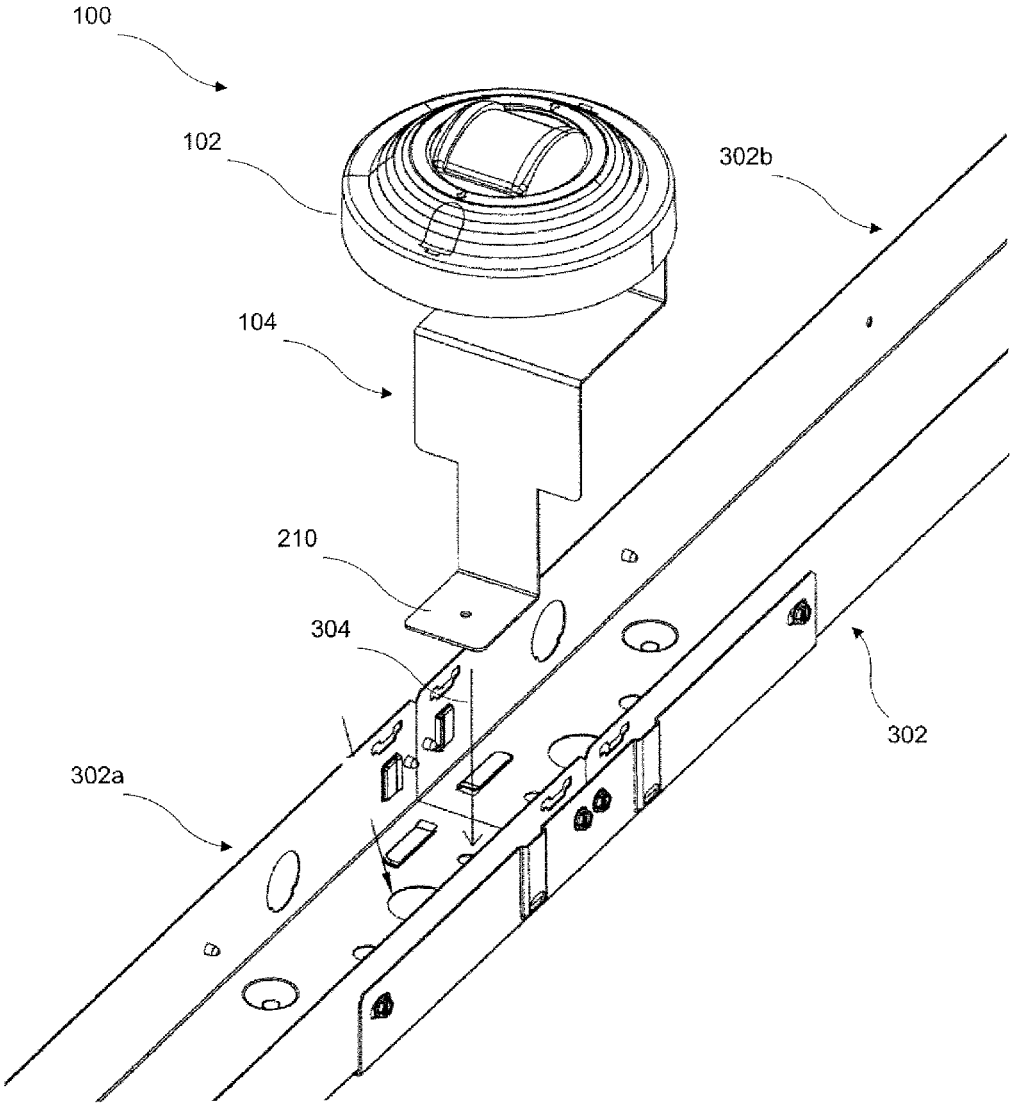
FIG. 3*a* is a perspective view of the installation of a motion sensor in a luminaire housing a motion sensor apparatus of FIG. 1 according to certain exemplary embodiments of the present invention.

FIG. 3*a* is a perspective view of the installation of a motion sensor 102 in a luminaire 302 according to certain exemplary embodiments of the present invention. FIG. 3*a* illustrates a first luminaire housing 302*a* and a second luminaire housing 302*b* in an end-to-end or linear orientation. The bracket 104 is coupled via the coupling member 210 to the first luminaire housing 302*a* through the opening 304.

Figure 3B:
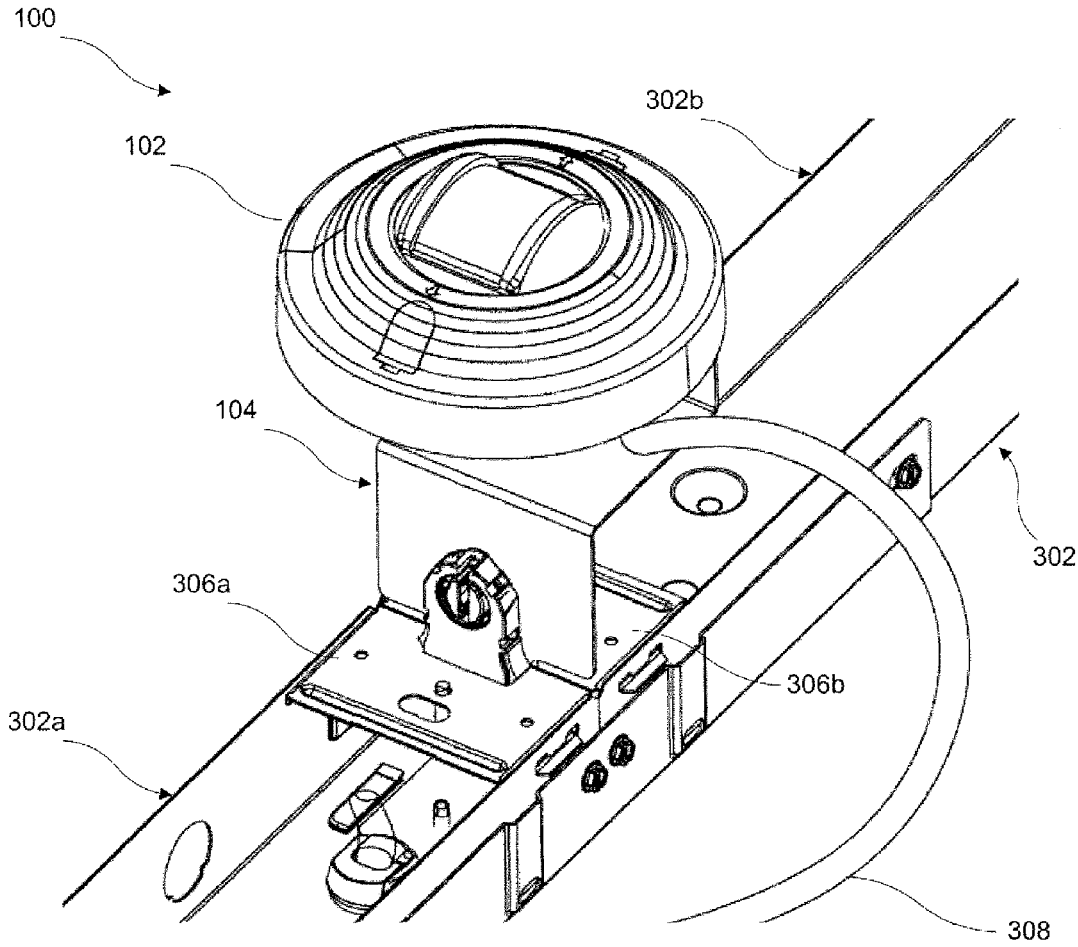
FIG. 3*b* is an illustration of a motion sensor apparatus of FIG. 1 coupled to a luminaire housing according to certain exemplary embodiments of the present invention.

FIG. 3*b* is a perspective view of a motion sensor 102 coupled to a luminaire 302 according to certain exemplary embodiments of the present invention. As illustrated by FIG. 3*b*, the bracket 104 allows the motion sensor apparatus 100 to be installed in the first luminaire housing 302*a* without extending the length of the first luminaire housing 302*a* or the combined overall length of the first and second luminaire housings 302*a*,302*b*. Accordingly, the motion sensor 102 is installed in the luminaire 302 without extending its total length. FIG. 3*b* also illustrates the power coupling 308 for the motion sensor 102, which is ultimately coupled to the power supply (not shown) for the luminaire 302 such that the motion sensor 102 can control the flow of power to one or both of the luminaire housings 302*a*,302*b*.

Figure 3C:
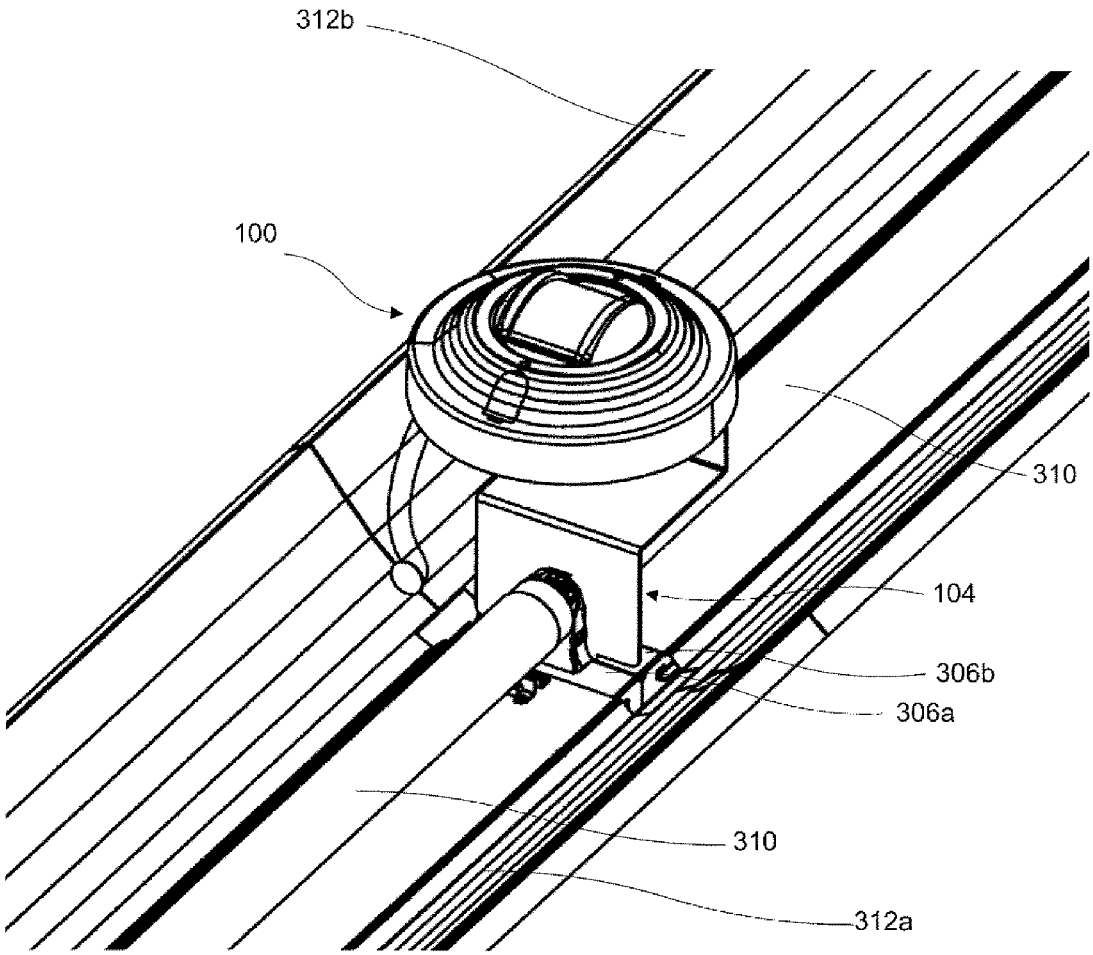
FIG. 3*c* is another perspective view of the motion sensor apparatus of FIG. 1 installed in a luminaire housing according to certain exemplary embodiments of the present invention.

FIG. 3*c* provides another perspective view of a motion sensor apparatus 100 installed in a luminaire 302 according to certain exemplary embodiments of the present invention. FIG. 3*c* illustrates two tubular lamps 310 and reflectors 312*a* and 312*b*. As is farther illustrated by FIG. 3*c*, the bracket 104 positions the motion sensor 102 such that it is installed in the luminaire 302 without extending the length of the luminaire 302. FIG. 3*c* also illustrates the functionality of the centering member 202. Specifically, the centering member 202 effectively centers the motion sensor 102 over the portion of the luminaire that does not generate light—the area over the lamp holders 306*a* and 306*b*. Thus, when installed, the motion sensor 102 blocks very little of the light that is provided by the lamps 310 installed in the luminaire 302.

As illustrated by the exemplary embodiment described in 3*c*, the bracket 104 positions the motion sensor under the luminaire 302 such that the combined length of the luminaire—the total length of the luminaire housings 302*a* and 302*b*—is not increased as a result of installing the motion sensor 102. Accordingly, multiple motion sensors can be installed in a luminaire made up of many luminaire housings 302*a*,302*b* without extending the total length of the luminaire 302. This provides a number of advantages. First, no changes need to be made to an existing structure to accommodate a luminaire 302 with motion sensors 102 installed.

Second, because the luminaire 302 with the motion sensors 102 installed will be the same length as similar luminaires 302 that are not equipped with motion sensors. Large facilities such as warehouses and factories will have many rows of luminaires 302. Because the bracket 104 provides the ability to install motion sensors 102 in some of the rows of luminaires 302 without extending the total length of each row, the rows of luminaires 302 will remain aligned with one another. By remaining aligned, the rows of luminaires 302 will continue to provide an even distribution of light according to the initial lighting design of the facility, which may also ensure that the light distribution within the facility complies with applicable building codes or other regulations.

Figure 4:
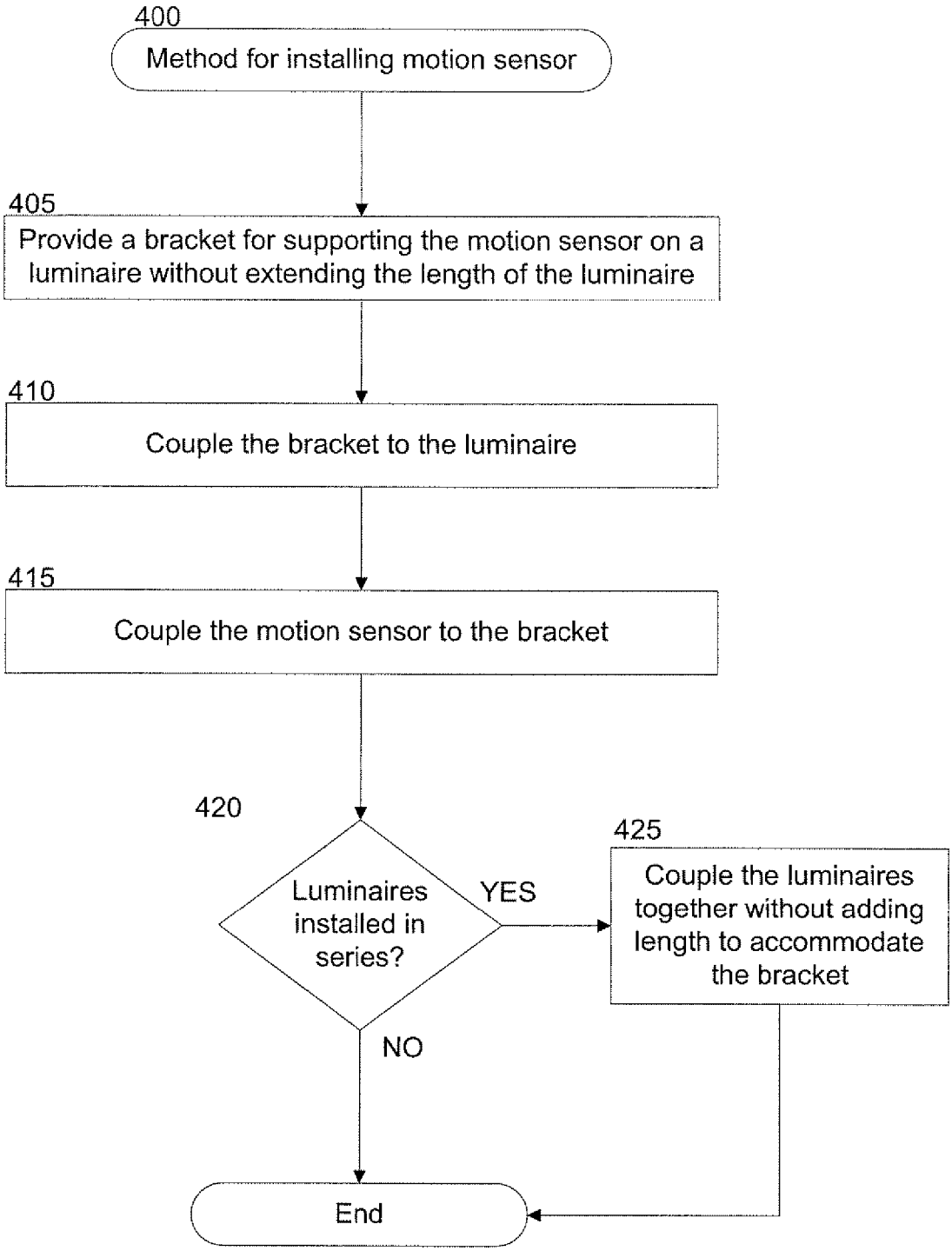
FIG. 4 is a flowchart describing a method for installing the motion sensor apparatus of FIG. 1 in a luminaire housing according to certain exemplary embodiments of the present invention.

FIG. 4 provides a flowchart illustrating a method for installing a motion sensor 102 according to one exemplary embodiment of the present invention. The method 400 will be described with reference to the structure described in FIGS. 2*a*-2*d*. Certain steps in the process flow of FIG. 4 must naturally precede others for the invention to function as described. However, the invention is not limited to the order of the steps described if such order or sequence does not alter the functionality of the present invention. That is, it is recognized that some steps may be performed before, after, or in parallel with other steps without departing from the scope and spirit of the present invention.

Additionally, it is recognized that certain steps could be re-arranged in different sequences or entirely deleted without deviating from the scope and spirit of the invention. In other words, it is recognized that the steps illustrated in the flow chart represent one way of installing a motion sensor in a luminaire. Other ways which may include adding different steps, eliminating steps, or a combination of eliminating steps and adding different steps will be apparent to one of ordinary skill in the art.

Referring now to FIGS. 2*a*-2*d* and 4, in step 405, the method 400 provides a bracket 104 for supporting a motion sensor 102 on a luminaire without extending the length of the luminaire. In step 410, the bracket 104 is coupled to the luminaire. The motion sensor 102 is coupled to the bracket 104 in step 415.

The method 400 then proceeds to decision step 420, wherein it is determined whether multiple luminaires are to be installed in an end-to-end or linear fashion. If the result of step 420 is negative, the method follows the "NO" to the End step. If, on the other hand, the result of step 420 is positive, the method follows the "YES" branch to step 425. In step 425, the luminaires are coupled together in an end-to-end or linear fashion to accommodate the bracket 104 without adding length to the luminaire. The method then continues to the End step.

Figure 5:
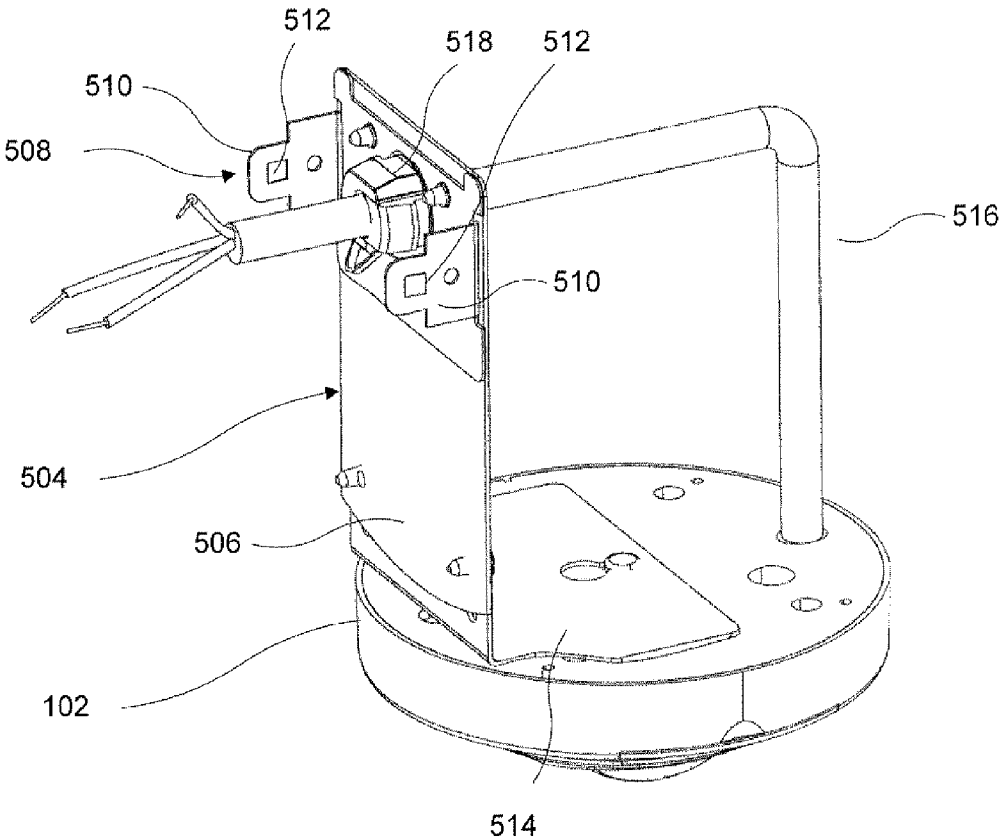
FIG. 5 is an illustration of a motion sensor installation bracket and corresponding luminaire according to another exemplary embodiment of the present invention.
Figure 5:
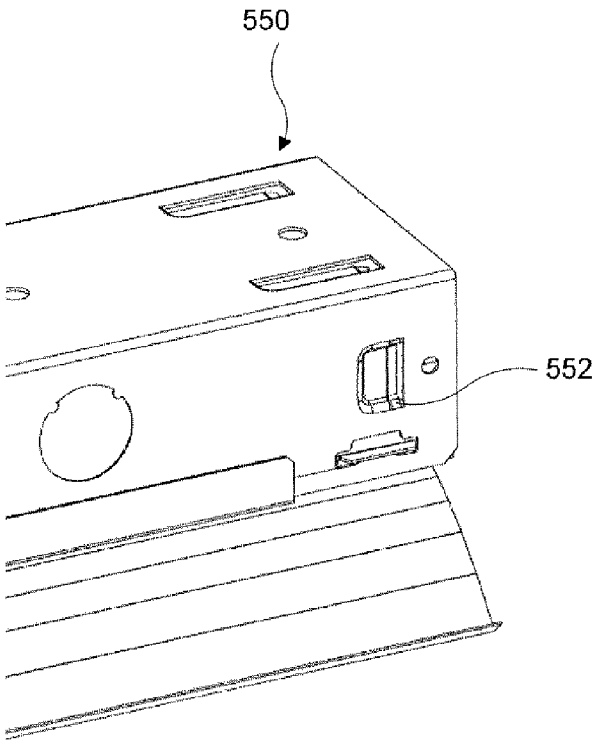

FIG. 5 is an illustration of a motion sensor installation bracket 504 and corresponding luminaire 550 according to another exemplary embodiment of the present invention. The bracket 504 in this embodiment is configured to couple a motion sensor 102 to the end of a luminaire 550 such that the bracket 504 does not increase the length of the luminaire 550. In this embodiment, the motion sensor 102 is disposed at a location substantially outside of the luminaire 550.

The bracket 504 includes a number of members that facilitate an appropriate coupling between the motion sensor 102 and the luminaire 550. In one exemplary embodiment, the bracket 504 and the corresponding members are formed from a single piece of material that has been plastically deformed, stamped, or molded to form the members. In an alternative embodiment, the members of the bracket 504 are formed individually and bonded or coupled together using adhesives, welding, fasteners, or any other appropriate bonding means. In an exemplary embodiment, the material forming the bracket 504 is a high strength metal such as steel or aluminum. Alternatively, the bracket 504 may be formed from another appropriate material, such as plastic or a composite material.

The bracket 504 includes a support member 506 that supports the motion sensor 102 in the luminaire 550 without extending the length of the luminaire 550. The support member 506 is coupled to an interfacing member 508 configured to provide a coupling interface between the support member 506 and the luminaire 550. The interfacing member 508 includes two engaging members 510 that engage with and are releaseably coupled to the slots 552 on the luminaire 550. When the engaging members 510 have engaged the slots, the engaging members 510 are held in place by tabs 512. The bracket 504 also includes an attachment member 514 configured to attach the bracket 504 to the motion sensor 102. The interfacing member 508 and the bracket 504 further define a strain relief apparatus 518 to prevent any force that may operate on the power supply cable 516 from damaging the motion sensor 102.

Based on the foregoing, it can be seen that the present invention provides an apparatus for installing a motion sensor in a luminaire without extending the length of the luminaire. The present invention also provides a method for installing a motion sensor in a luminaire without extending the length of the luminaire. Many other modifications, features and embodiments of the present invention will become evident to those of ordinary skill in the art. It should be appreciated, therefore, that many aspects of the present invention were described above by way of example only and are not intended as required or essential elements of the invention unless explicitly stated otherwise. Accordingly, it should be understood that the foregoing relates only to certain exemplary embodiments of the invention and that numerous changes may be made therein without departing from the spirit and scope of the invention as defined by the following claims.

What is claimed is:

1. An apparatus for installing a lighting accessory to a first luminaire comprising a first luminaire housing, the apparatus comprising:

a lighting accessory bracket comprising:

a coupling member operative to couple the bracket to the first luminaire housing;

a support member extending from the coupling member and operative to support the lighting accessory a first distance from the first luminaire housing; and an attachment member extending from the support member operative to attach the lighting accessory to the bracket;

wherein the bracket is operative to couple the lighting accessory to the first luminaire housing without increasing a combined length of the first luminaire and a second luminaire positioned adjacent one another in an end-to-end configuration.

2. The bracket of claim 1, wherein the lighting accessory is a motion sensor operative to control the power to at least one of the first luminaire and the second luminaire.

3. The bracket of claim 1, wherein the lighting accessory is a photocell operative to control the power to at least one of the first luminaire and the second luminaire.

4. The apparatus of claim 1, wherein the second luminaire further comprises a second luminaire housing operative to be coupled to the first luminaire housing, and wherein the bracket is disposed between the first luminaire housing and the second luminaire housing without increasing the combined length of the first luminaire and the second luminaire.

5. The bracket of claim 1, further comprising a centering member disposed between the support member and the attachment member and operative to laterally displace the attachment member with respect to the support member, and wherein the attachment member is operative to attach to the lighting accessory such that the lighting accessory is substantially centered beneath a junction of the first luminaire and the second luminaire.

6. The apparatus of claim 1, wherein the bracket is formed from a single piece of metal plastically deformed to form the coupling member, the support member, and the attachment member.

7. The apparatus of claim 1, wherein the first distance is such that the bracket and the lighting accessory are disposed in a spaced apart orientation from a lamp installed in the luminaire.

8. The apparatus of claim 1, wherein the first distance is sufficient to dispose the lighting accessory in a spaced apart orientation from one of a T5 lamp and a T8 lamp.

9. A lighting system comprising:

a plurality of fluorescent luminaires, each luminaire comprising:

a length greater than its width;

a first luminaire housing and a second luminaire housing operative to support first and second fluorescent lamps, wherein an endpoint of the first luminaire housing is positioned adjacent an endpoint of a second luminaire housing, providing a linear configuration for the plurality of luminaires;

a bracket coupled to the first luminaire housing and operative to position a lighting control device along the endpoints of the first and second luminaires, wherein the lighting control device is electrically coupled to at least one of the first and second luminaire and operative to control at least one aspect of at least one of the plurality of fluorescent luminaries, wherein a combined length of the first and second luminaire comprising the bracket and the lighting control device is substantially equal to the combined length of the first and second luminaire alone.

10. The lighting system of claim 9, wherein the plurality of fluorescent luminaires comprises a plurality of T8 fluorescent fixtures.

11. The lighting system of claim 9, wherein the plurality of fluorescent luminaires comprises a plurality of T5 fluorescent fixtures.

12. The lighting system of claim 9, wherein the bracket comprises:

a coupling member operative to couple the bracket to the first luminaire housing;

a support member extending from the coupling member and operative to support the lighting accessory a first distance from the first luminaire housing; and an attachment member extending from the support member operative to attach the lighting accessory to the bracket.

13. The lighting system of claim 12, wherein the bracket further comprises a centering member disposed between the support member and the attachment member operative to displace the attachment member, wherein the attachment member is operative to attach to the lighting control device such that the lighting control device is substantially centered below the endpoints of the first and second luminaire.

14. The lighting system of claim 12, wherein the bracket is formed from a single piece of metal plastically deformed to form the coupling member, the support member, and the attachment member.

15. The lighting system of claim 12, wherein the first distance is such that the bracket and the lighting control device are disposed in a spaced apart orientation from a lamp installed in the luminaire.

16. The lighting system of claim 9, wherein the lighting control device is a motion sensor operative to control the flow of power to at least one of the luminaire housings.

17. The lighting system of claim 9, wherein the lighting control device is a photocell operative to control the flow of power to at least one of the luminaire housings.

18. A method of coupling a lighting control device to one of a plurality of fluorescent luminaires positioned linearly with respect to one another comprising:

providing, for each luminaire, a luminaire housing comprising a first end and a second end along a length of the housing for each luminaire;

positioning a first luminaire housing adjacent a second luminaire housing in an end-to-end orientation;

providing an attachment member operative to couple the lighting control device adjacent one end of the luminaire housing without extending a combined length of the first and second luminaire;

coupling the attachment member to the first luminaire housing; and coupling the lighting control device to the attachment member.

19. The method of claim 18, wherein the support member comprises a bracket, the bracket comprising:

a coupling member operative to couple the bracket to the first luminaire housing;

a support member extending substantially orthogonally from the coupling member and operative to support the lighting control device a first distance beneath the first luminaire housing; and an attachment member extending substantially orthogonally from the support member and operative to attach the lighting control device to the bracket, wherein the attachment member substantially centers the lighting control device below the endpoints of the first and second luminaires.

20. The method of claim 18, further comprising the step of coupling the second luminaire housing to the first luminaire housing such that at least a portion of the bracket is disposed between the first luminaire housing and the second luminaire housing.

21. The method of claim 20, further comprising the steps of:

coupling a first lamp to the first luminaire housing;

coupling a second lamp to the second luminaire housing; and electrically coupling the lighting control device to at least one of the first and second luminaires; and controlling one of the first lamp and the second lamp with the lighting control device.

* * * * *